United States Patent [19]

Wheatley, Jr.

[11] 4,088,941

[45] May 9, 1978

[54] VOLTAGE REFERENCE CIRCUITS

[75] Inventor: Carl Franklin Wheatley, Jr., Somerset, N.J.

[73] Assignee: RCA Corporation, New York, N.Y.

[21] Appl. No.: 729,766

[22] Filed: Oct. 5, 1976

[51] Int. Cl.[2] ..... G05F 1/60

[52] U.S. Cl. ..... 323/8; 323/19

[58] Field of Search ..... 323/1, 4, 8, 19, 22 T; 330/17, 22, 23, 25, 30 D, 40, 257, 256, 296, 297

[56] References Cited

U.S. PATENT DOCUMENTS

| | | | |
|---|---|---|---|
| 3,535,613 | 10/1970 | Katzenstein | 323/8 |
| 3,648,153 | 3/1972 | Graf | 323/19 |
| 3,781,699 | 12/1973 | Sakamoto | 330/22 X |
| 3,851,241 | 11/1974 | Wheatley | 323/8 |
| 3,962,592 | 6/1976 | Thommen et al. | 330/22 X |
| 4,021,722 | 5/1977 | Crowle | 323/4 |

OTHER PUBLICATIONS

RCA Transistor, Thyristor & Diode Manual, Technical Series SC-15, Apr. 1971, pp. 234, 235.

*Primary Examiner*—A. D. Pellinen

*Attorney, Agent, or Firm*—Harold Christoffersen; Allen LeRoy Limberg

[57] ABSTRACT

A first reference voltage which exhibits a negative coefficient of change with temperature is developed as an offset potential across a forward-biased semiconductor junction or a series string of such junctions operated at an absolute temperature T. A second reference voltage which varies in linear proportion to the absolute temperature T is additively combined with the first reference voltage to simulate a higher density of forward current flow through the semiconductor junctions.

7 Claims, 3 Drawing Figures

VOLTAGE REFERENCE CIRCUITS

The present invention relates to circuits, which are well-suited to construction in monolithic integrated circuit form or the like, for supplying reference voltages having a well-defined and predictable behavior as the temperature of the circuit changes.

U.S. Pat. No. 3,851,241 granted Nov. 26, 1974 to the present inventor, describes a "Temperature Dependent Voltage Reference Circuit" which provides a reference voltage linearly proportional to the difference between the base potentials of first and second junction transistors operated with different densities of current flow through them. the first and second transistors have base-emitter junctions formed by the same process steps with respective areas in 1:*m* ratio, are operated at the same absolute temperature, are connected at their emitter electrodes to receive a bias current to be apportioned between them, and have their collector currents differentially combined in a current amplifier, used as a balanced to single-ended signal converter and possessed of a current gain $-g$, $g$ being a positive number which when multiplied by $m$ yields a product not equal to unity.

The single-ended output signal is an error signal which is amplified and applied to the input port of a resistive potential divider having its output port connected between the base electrodes of the first and second transistors to complete a degenerative feedback loop. This loop regulates the potential at the input port of the resistive potential divider so the potential at its output port maintains a difference potential between the base electrodes of the first and second transistors to reduce the error signal to nearly zero value. If the resistive potential divider is a linear potential divider, its output potential being an invariant fraction of its input potential, these output and input potentials vary in linear proportion to the absolute temperature at which the first and second transistors are operated. The prior invention was conceived of primarily as an electronic thermometer or a temperature sensing unit for use in conjunction with further control apparatus, and the possibility of a wide range of application for the circuit was perceived.

The present invention, based on investigations subsequent to the making of the prior invention, is directed to combinations in which arrangements similar to those of the prior invention are used to obtain positive-temperature-coefficient potentials which are additively combined with negative-temperature-coefficient potentials as obtained, directly or proportionately, from the offset potential across a forward-biased semiconductor junction or a series connection of such junctions.

Figure 1:
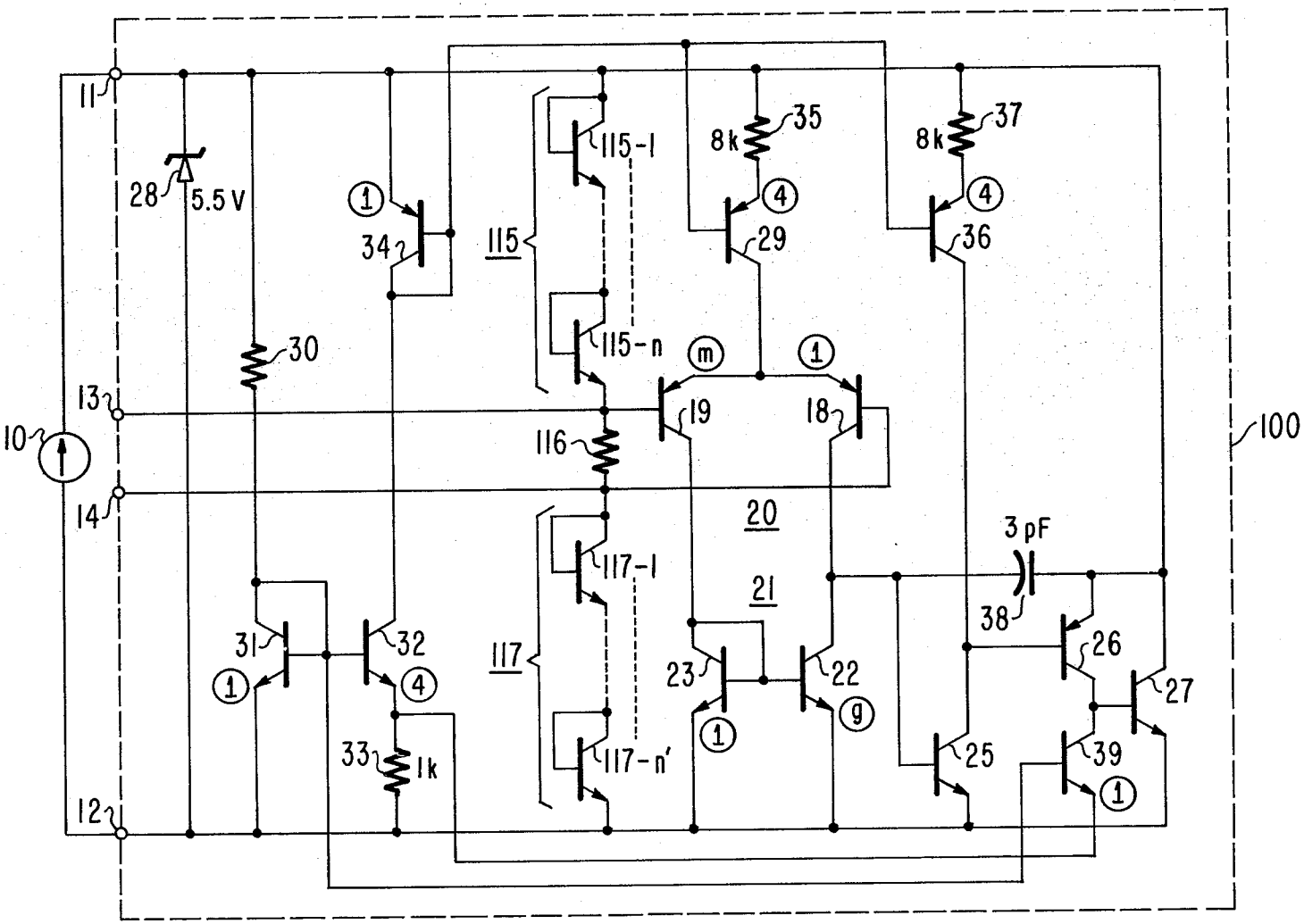
FIG. 1 shows a multiple-$V_{BE}$ supply of a shunt regulator type which embodies the present invention.

FIG. 1 shows, in the dashed box, a voltage regulator 100 of the type for providing a reference voltage directly proportional to the offset potential across a forward-biased semiconductor junction at a source impedance relatively low compared to the impedance normally exhibited by a forward-biased semiconductor junction for a given current level. Such voltage regulators are commonly referred to as "multiple-$V_{BE}$ supplies", and a continuing interest is to find supplies of this type lower source impedance. This interest is particularly keen with regard to the design of a complex subsystem to be fitted within the confines of a monolithic integrated circuit, because this type of supply is often used to provide a reference voltage to a plurality of stages and cross-coupling of the stages through the supply is usually not desirable. A multiple-$V_{BE}$ supply of the type employing a string of self-biased transistors N in number, conducting an applied current can be shown to exhibit a source of impedance substantially equal to $N/g_m$, where $g_m$ is the transconductance of any of the transistors and has a value of about 40 millimhos per milliampere of applied current. Similar source impedance is exhibited by a multiple-$V_{BE}$ supply of the type described in Bisgaard in U.S. Pat. No. 3,629,717 wherein the collector-to-emitter path of a transistor is conditioned to conduct an applied current by collector-to-base feedback implemented with a resistive potential divider dividing emitter-to-collector potential by N for application as emitter-to-base potential. Graf in U.S. Pat. No. 3,648,153 describes the replacement of the resistive potential divider by a potential divider comprising serially connected self-biased transistors.

The commonly used multiple-$V_{BE}$ supplies which exhibit still lower source impedances employ feedback configurations which operate in effect as series voltage regulators —e.g., as described by Hardwood in U.S. Pat. No. 3,430,155 and Limberg in U.S. Pat. No. 3,555,309. Such a series regulated supply tends to exhibit acceptably low source impedance when the load is applied so as to lend to reduce the output voltage of the regulator, but when the load is applied so as to tend to increase the output voltage the source impedance tends to rise unacceptably. This tendency is noted by Limberg in RCA Technical Note No. 953 mailed Feb. 4, 1974, and entitled "Improved IC Internal References". The note suggests a shunt regulator working to maintain parallel loading of either of the series-regulated supplies referred to above.

The type of shunt regulator described by Limberg senses output current from the supply in the collector circuit of an emitter-follower transistor having its emitter electrode connected to one of the output terminals of the reference voltage. It is desirable in many applications to sense the current with elements between the output terminals of the supply. In particular, this is necessary in integrated-circuit reference voltage supplies wherein the reference voltage is developed between the same pair of terminals to which the energizing current to run the supply is applied. At the same time, the sensing elements must not interfere with the multiple-$V_{BE}$ characteristic of the reference voltage the supply provides.

In FIG. 1, a current source 10 (which may, for example, comprise a battery and a dropping resistor in series connection) is connected between terminals 11 and 12 of voltage regulator 100, between which the desired reference potential is to be maintained. Diode 28 protects the remainder of the elements in voltage regulator 100, supposing it to be constructed in monolithic integrated circuit form, from source 10 being applied in erroneous polarity and from fast rising transients. Elements 29–37 operate as described in U.S. Pat. No.

3,851,241 to cause equal-valued, substantially constant collector currents $I_{C29}$ and $I_{C36}$ to be supplied from transistor 29 and 36, respectively. Transistor 39 is arranged to demand a collector current, $I_{C39}$, used to pull down the base electrode of shunt-regulator transistor 27 should the conduction of transistor 26 be reduced.

Transistors 18 and 19 in the differential-input, single-ended-output amplifier 20 have their emitter electrodes directly connected to each other and are connected to receive the collector current of transistor 29. The transconductance of transistor 19 for any given value of similar base-emitter potentials is *m* times as large as that of transistor 18. This can be achieved by proportioning the effective areas of the base-emitter junctions of transistors 18 and 19 in 1:*m* ratio respectively or, if they are lateral-structure devices, by proportioning their collector efficiencies in like ratio. The potential drop $V_{116}$ across resistor 116, as applied between the base electrodes of transistors 18 and 19, will control the apportioning of $I_{C29}$ to flow as the emitter currents $I_{E18}$ and $I_{E19}$ of transistors 18 and 19, respectively. The collector current $I_{C19}$ of transistor 19 is applied to a current amplifier 21 to cause a current response $-g$ times as large, which is combined with the collector current $I_{C18}$ of transistor 18. The combined currents give rise to an error signal applied to the base electrode of common-emitter transistor 25.

The error signal applied to the base electrode of transistor 25 is amplified in turn by transistor 25, 26, and 27 and the resultant amplified error signal flows between terminals 11 and 12, shunting current flow from a conduction path between terminals 11 and 12 which includes resistor 116 and correcting the drop $V_{116}$ across resistor 116 so as to reduce the error signal. The shunt regulator 100 can thus be viewed as a direct coupled feedback loop used to adjust $V_{116}$ to a prescribed value. The high gain of the cascaded transistors 25, 26, 27 permits a very small error signal to support this correction.

Current amplifier 21 may (as shown) comprise transistors 22 and 23 having respective transconductances in *g* to 1 ratio, respectively, for any given value of similar base-emitter potentials, and being connected in current mirror amplifier configuration. The product of *m* times *g* is chosen in excess of unity. In accordance with the teaching of U.S. Pat. No. 3,851,241, it can be shown, proceeding from equation (1) appearing later in this specification, that for substantially zero value of error signal to obtain, $V_{116}$ has an equilibrium value of $(kT/g)ln$ mg, where *k* is Boltzmann's constant, T is the absolute temperature at which both transistors 18 and 19 are operated, and *q* is the charge on an electron.

Resistor 116 is serially-connected together with a first plurality 115 of serially-connected self-biased transistors **115-*l* . . . 115-*n* and a second plurality of serially-connected self-biased transistors 117-*l* . . . 117-*n'* between terminals 11 and 12. These self-biased transistors, like transistors 18 and 19, are arranged to be operated at an absolute temperature T. So, neglecting the base currents of transistors 18 and 19, the same current $I_{116}$ as flows through resistor 116 flows as emitter current in each of the transistors 115-*l* . . . 115-*n*, 117-*l* . . . 117-*n'*. Resistor 116 may, then, be viewed as a current sensing resistor in series connection with the semiconductor diode means 115-*l* . . . 115-*n*, 117-*l* . . . 117-*n'*. The equilibrium value of $I_{116}$ is simply calculated, according, to Ohm's Law, by dividing the $(kT/g)ln$ mg potential across the resistor 116 by its resistance, $R_{116}$. A slight difference in $I_{116}$ from its equilibrium value will cause an error signal at the base electrode of transistor 25 larger by the gain of the amplifier 20. This error signal is amplified further by the current gains of cascaded transistors 25, 26, 27 to apply shunt regulation between terminals 11 and 12. Capacitor 38 provides the primary roll-off of frequency response in direct-coupled feedback loop used to effect shunt regulation that is necessary to prevent the loop from oscillatory tendencies. The impedance between terminals 11 and 12 is that of the series connection of 115, 116, 117 with the feedback loop through 20, 25, 26, 27 opened at the ouput circuit of amplifier 27, divided by the current gain of the open loop. Assuming $R_{116}$ to be relatively small, the open-loop impedance of the series connection of 115, (116), 117** is $(n+n')/g_m$ where $g_m$ has a value of about 40 millimhos per milliampere of $I_{116}$.

The following question naturally arises: how does the potential drop across resistor 116 after the multiple-$V_{BE}$ character of the reference voltage appearing between terminals 11 and 12? The difference between the base-emitter offset potentials of first and second transistors of the same basic semiconductor material formed by the same processing steps and operated at the same temperature is $(kT/q)ln\ (I_{C1}A_2/I_{C2}A_1)$ where $I_{C1}$ and $I_{C2}$ are their respective collector currents and $A_1$ and $A_2$ are the respective effective areas of their respective base-emitter junctions. This difference varies with temperature the same way as $V_{116}$. So, $V_{116}$ may be simply absorbed by altering the areas of the base-emitter junctions of transistors **115-*l* . . . 115-*n*, 117-*l* . . . 117-*n* to accomodate difference in offset poential between terminals 12 and 11 caused by $V_{116}$, supposing these transistors to be operated at a temperature close to that at which transistors 18 and 19** are operated.

An external resistor may be connected between terminals 13 and 14 of voltage regulator 100 to increase the level of current flow through 115 and 117, and this external resistor may be made adjustable. Resistor 116 may be made (e.g., by ion implantation) to have a positive-temperature-coefficient of 1 part in T parts per degree Kelvin where T is the absolute temperature in degrees Kelvin near which the integrated-circuit components are operated; this will result in a temperature-independent current flow through 115, 116, 117. The conductivity types of the transistors 18, 19, 23, 22 in differential-input, single-ended output amplifier 20 may be reversed, requiring the biasing and direct-coupling to its input and output ports to be redesigned, naturally. The amplifier cascade comprising transistors 25, 26, 27 can be replaced by a variety of other current amplifiers. The $V_{BE}$ offset across one or more of the transistors in semiconductor diode means 115 and 117 can be used for biasing other semiconductor circuitry on the same integrated circuit die as voltage regulator 100.

Figure 2:
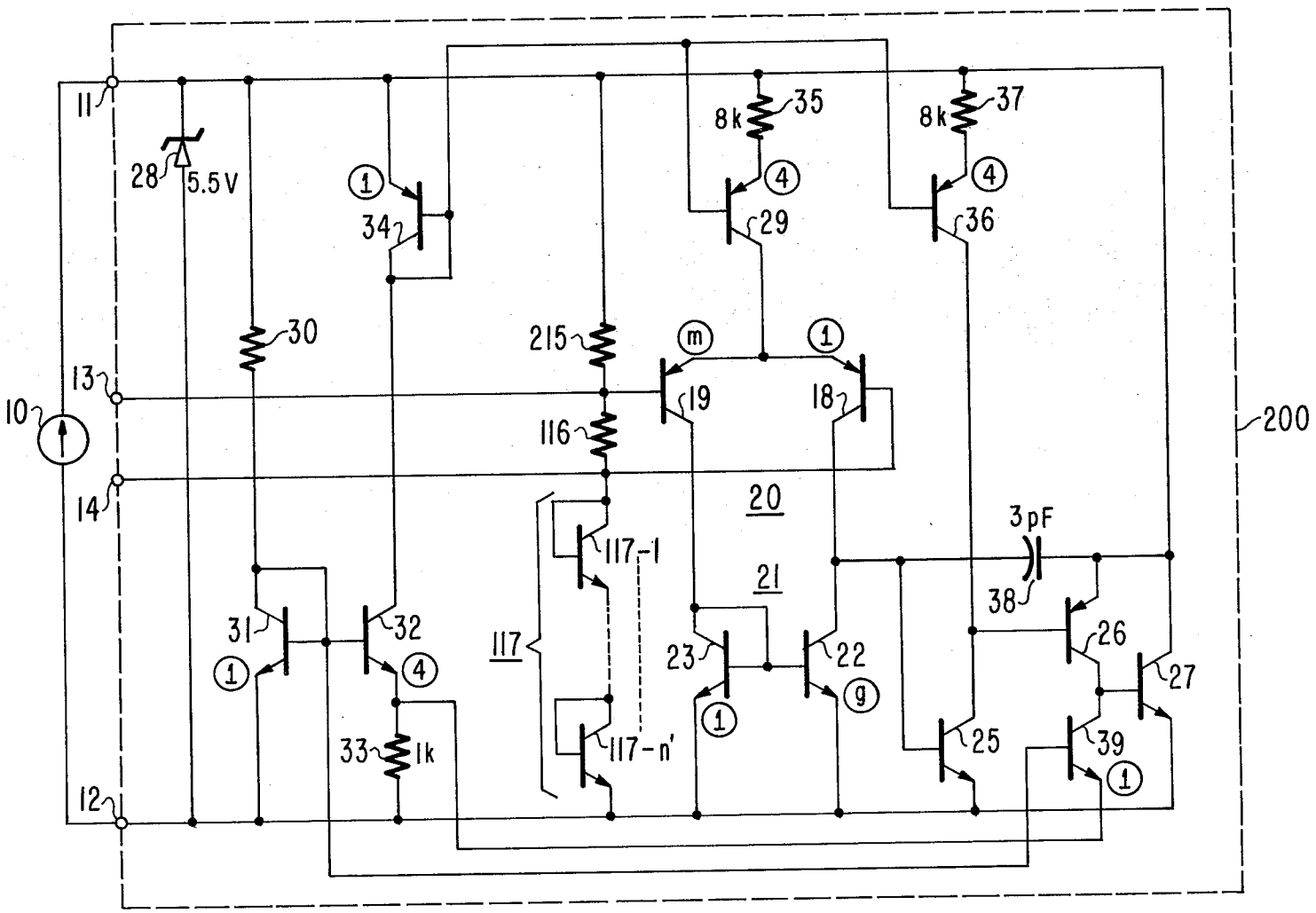
FIG. 2 shows a voltage reference circuit which can be designed to supply a zero-temperature-coefficient reference voltage and embodies the present invention.

Before considering FIG. 2, one should recall the following well-known equation descriptive of transistor action.

$$V_{BE} = (kT/q)ln(I_E/AJ_S) \quad (1)$$

where $V_{BE}$ is the base-emitter potential of the transistor,
*k* is Boltzmann's constant,
*T* is the absolute temperature of the transistor,
*q* is the charge on an electron,
$I_E$ is the emitter current of the transistor,
*A* is the effective area of its base-emitter junction, and $J_S$ is the density of current flow through that junction for the condition $V_{BE} = 0$.

$J_S$ is the same for any pair of transistors fabricated on the same semiconductor substrate by identical process steps and operated at the same temperature T. The other terms will be identified to a particular transistor by a subscript corresponding to its identification numeral. The $V_{BE}$ of a transistor is logarithmically related to $I_E/A$, the density of current flow through its base-emitter junction, and can be increased either by causing increased emitter current flow in the transistor or by reducing the effective area of its base-emitter junction. Now, suppose, as is the case in monolithic integrated circuitry, that there is a constraint upon how small A can be because of mask resolution etc., and a constraint upon how large $I_E$ can practicably be, usually imposed by the need to keep thermal dissipation acceptably low. $I_E/A$ has then a maximum practical value, $(I_{EMAX}/A_{MIN})$, imposing in a turn a limit upon the value of $V_{BE}$.

It may be desired, however, to operate with higher $V_{BE}$. For example, this desire may be motivated by a desire to affect the negative-temperature-coefficient of the $V_{BE}$. The change in $V_{BE}$ per degree of change in absolute temperature T is theoretically $(E_{g0} - V_{BEO})/T_0$, where $E_{g0}$ and $V_{BEO}$ are the respective values of band gap voltage and of $V_{BE}$ at an arbitrary absolute temperature $T_0$. Increasing $V_{BE}$ will decrease its negative coefficient of change with temperature.

This latter observation supplies a key for attempting to simulate the $V_{BE}$, $V_{BE1}$, of a first transistor operated with an $I_E/A$ of $I_{E1}$ which is greater than $I_{EMAX}/A_{MIN}$. One can augment the $V_{BE}$, $V_{BE2}$, of a second transistor operated with an $I_E/A$ of $I_E/A_2$, which is smaller than $I_{EMAX}/A_{MIN}$ with a positive-temperature-coefficient potential. This potential must equal $V_{BE1}$—$V_{BE2}$, the value of which can be derived beginning from equation (1).

$$V_{BE1} - V_{BE2} = (kT/g)\ ln\ (I_{E1}/A_1J_S) - (kt/q)\ ln\ (I_{E2}/A_2J_S) = (kT/q)\ ln\ [(I_{E1}/I_{E2})\ (A_2/A_1)] \quad (2)$$

To get this potential difference $(V_{BE1} - V_{BE2})$ one should understand it to be possible to scale up by fixed proportion from the difference between the respective base-emitter emitter potentials $V_{BE3}$ and $V_{BE4}$ of third and fourth transistors operated with $(I_E/A)$'s respectively of value $I_{E3}/A_3$ and of value $I_{E4}/A_4$ both of which are less than $I_{EMAX}/A_{MIN}$. This scaling up operation can be done in much the same way it is done in the temperature-dependent voltage reference circuits described in U.S. Pat. No. 3,851,241.

Sufficient increase of the positive temperature coefficient potential relative to the negative-temperature coefficient $V_{BE2}$ offset potential will simulate the very high $I_{E1}/A_1$ condition where $V_{BE0}$ equals $V_{g0}$ and result in a simulated $V_{BE1}$ with zero-temperature-coefficient. That is, the positive-and negative-temperature-coefficients of $V_{BE2}$ and $V_{BE1} - V_{BE2}$ will compensate each other when added together.

FIG. 2 shows a voltage regulator 200 which is similar in structure to voltage regulator 100, but in which a resistor 215 replaces semiconductor diode means 115. Like 100, regulator 200 regulates $V_{116}$ to an equilibrium value of $(kT/q)\ ln$ mg and a current $I_{116}$ equal to $V_{116}$ divided by $R_{116}$ flows through resistor 116. Except for the base currents of transistors 18 and 19, assumed to be negligible compared to $I_{116}$, the same current flows through resistors 215 and 116 and semiconductor diode means 117 comprising a plurality of self-biased transistors **117-*l* . . . 117-*n'***, which are *n* in number. The potential $V_{10}$ appearing between terminals 12 and 11 is the sum of the potential drops across elements 215, 116 and 117 due to $I_{116}$. If one assumes the same base-emitter offset potential $V_{BE117}$ to appear across each of self-biased transistors **117-*l* . . . 117-*n'*** due to $I_{116}$; the following equation describes the steady-state value of $V_{10}$.

$$V_{10} = n'V_{BE117} + [1+(R_{215}/R_{116})]\ (kT/q)ln\ mg \quad (3)$$

The first term, $n'V_{BE117}$, is a negative temperature coefficient term and the second term, the positive-temperature-coefficient term. This second term does not depend upon the absolute value of resistance, well-known to be a poorly predictable parameter in integrated circuit resistors. Rather, it depends upon the ratio of the resistances of resistors which can be accurately maintained during the course of integrated circuit manufacture. This is so despite temperature dependency of their resistances, if they are fabricated similarly and operated at substantially the same temperature, as can be the case if they are close together on the integrated circuit die. By changing the ratio $R_{215}/R_{116}$, one simulates changing the density of current flow through the base-emitter junctions of self-biased transistors **117-*l* . . . 117-*n'***.

A procedure of the following sort permits one to determine the appropriate value of $R_{215}/R_{116}$ so as to simulate the very high density of current flow through the base-emitter junctions of transistors **117-*l* . . . 117-*n'*** required to make $V_{10}$ temperature-independent. Convenient values of *n'*, *m* and *g* are chosen. The number *n'* of self-biased diodes **117-*l* . . . 117-*n'*** is chosen large enough so that $V_{10}$ will be a large enough operating potential for all the circuitry. In this configuration, *n'* is at least two. The product mg is chosen as much in excess of unity as possible so $R_{215}/R_{116}$ is not inordinately large, which would adversely affect scaling accuracy. One has previously obtained plots, for the type of transistor to be used, of the change in base-emitter voltage $V_{BE}$ at various levels of emitter current with change in temperature. A level of current flow through elements 215, 116, 117 is chosen and the negative-temperature-coefficient component of $V_{10}$ is determined. E.g., the $V_{BE}$ of a silicon NPN transistor at 1 milliampere emitter current may be 625 millivolts at a base temperature of 300° K and exhibit a substantially linear decrease of 2.2 millivolts per degree Kelvin rise in temperature, which multiplied by *n'* would give the negative-temperature-coefficient component of $V_{10}$. Now differentiating equation (3) by T will yield equation (4), following:

$$(dV_{10}/dT) = n'\ (dV_{BE117}/dT) + [1+(R_{215}/R_{116})](k/q)ln\ (mg) \quad (4)$$

Since $V_{10}$ is not to vary, $(dV_{10}/dT)$ is zero-valued. Equation (4) may be solved to determine $R_{215}/R_{116}$, taking this fact into account.

$$R_{215}/R_{116} = -1 - n(dV_{BE117}/dT)/[(k/q)ln\ (mg)] \quad (5)$$

The value of $R_{215}/R_{116}$ is now introduced back into equation (3) to calculate the value of $V_{10}$ at the base temperature—more particularly, its positive-temperature-coefficient component, since the negative temperature coefficient is already known. Knowing the positive-temperature-coefficient component of potential and the assumed level of current flow through 215, 116, 117, one can calculate by Ohm's Law the sum value of $R_{215}$ and $R_{116}$. Knowing the ratio of $R_{215}$ to $R_{116}$ as well as $R_{215} + R_{116}$, one can readily calculate the values of $R_{215}$ and $R_{116}$.

Resistive elements 215 and 116, if fabricated by the same diffusion process used to make base regions for the NPN vertical-structure transistors in a monolithic integrated circuit, will have resistances with positive-temperature-coefficients which substantially track the positive-temperature-coefficient potential between terminals 11 and 14. This causes the current flowing in these resistive elements 215 and 116 to be substantially constant with temperature, substantially avoiding change in the $V_{BE}$'s of the self-biased transistors 117-*l* . . . 117-*n'* caused by change in applied current. This largely eliminates another temperature-dependent variable from having to be taken into account, making the calculations outlined in the foregoing paragraph sufficient for describing and predicting circuit performance. Alternatively resistive elements 115 and 116 can be ion-implanted resistive elements to match their temperature coefficients of resistance still more closely with the temperature coefficient of the potentials ideally appearing across them.

The voltage regulator 200 may be modified by changing the order of elements in the series connection between terminals 11 and 12 that includes resistor 116. E.g., the relative positions of semiconductor diode means 117 and resistor 215 may be exchanged; or resistor 215 may appear in two parts, one between terminals 11 and 13 and the other between terminals 14 and 12.

Modifications of voltage regulator 200 which facilitate the adjustment of the nominally zero temperature coefficient of $V_{10}$ to make it actually more nearly equal to zero are contemplated. Adjusting the negative-temperature-coefficient component of $V_{10}$ entails changing the value of current flow through the semiconductor diode means 117 (e.g., by resistively shunting terminal 14 to terminal 11 or 12) or changing the effective area of the base-emitter junctions of a transistor or transistors in semiconductor diode means 117 (e.g., through the use of a multiple-emitter transistor structure). It is generally simpler to adjust the positive-temperature-coefficient component of $V_{10}$ by adjusting the ratio of the resistances of resistors 215 and 116 or by replacing the particular type of current amplifier 21 shown with a type having adjustable current gain. An additional degree of freedom in adjustment of $V_{10}$ may be desired in order to trim its value for the zero temperature coefficient to obtain. This may be furnished by making the semiconductor diode means 117 including a transistor with an adjustable potential divider in its collector-to-base feedback, but then the adjustments of the nominal value of $V_{10}$ and of its temperature-coefficient cannot be independently made.

Figure 3:
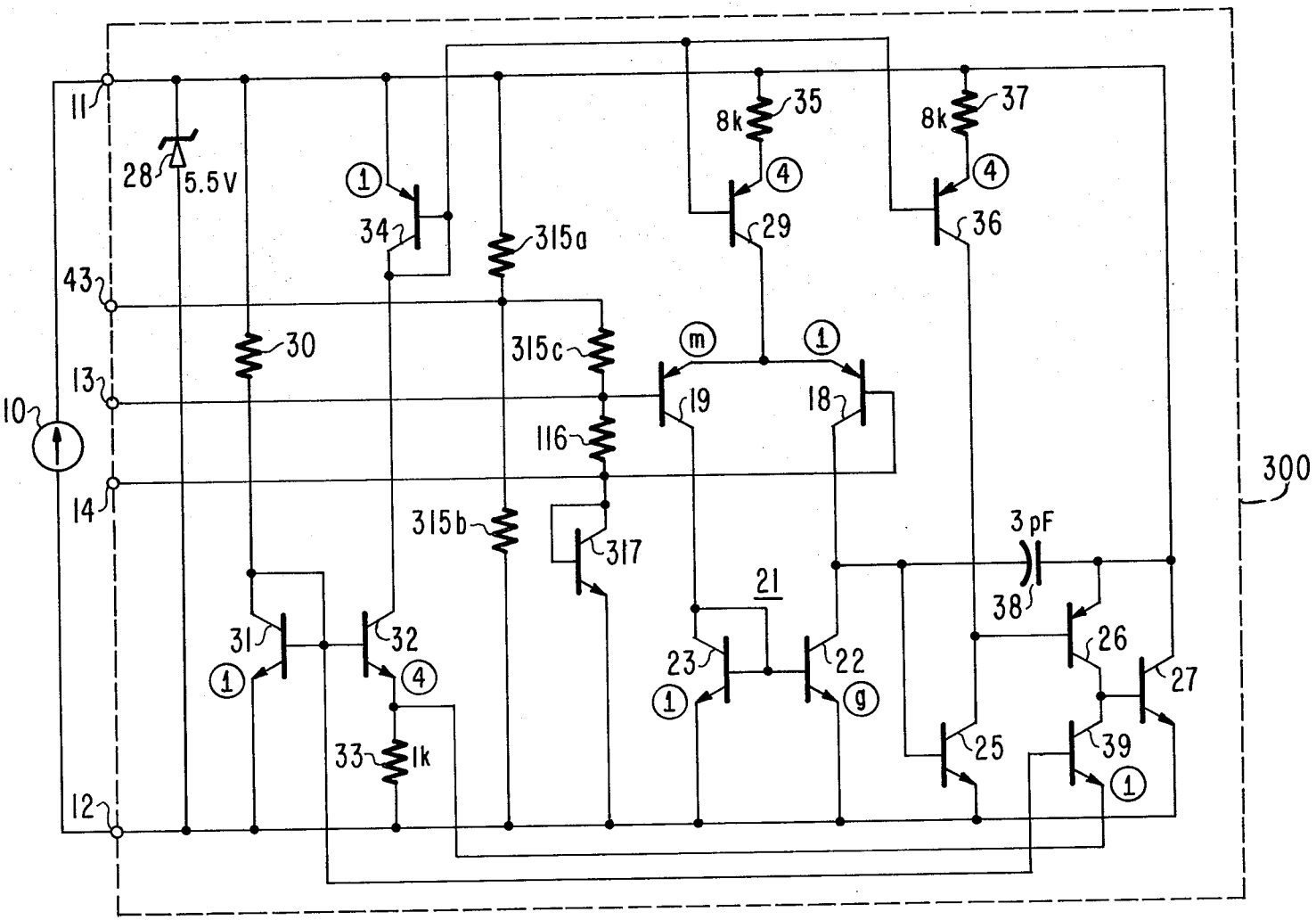
FIG. 3 shows a voltage reference circuit which is an alternative to that of FIG. 2 and embodies the present invention.

FIG. 3 shows a voltage regulator configuration 300, a modification of regulator 200 better suited for making these adjustments independently of each other. Resistor 215 is replaced by a network of resistors 315*a*,315*b*,315*c*. Resistors 315*a* and 315*b* can have respective resistances $R_{315a}$ and $R_{315b}$ which in parallel offer low resistance as compared to resistance $R_{315c}$ of resistor 315*c* plus $R_{116}$ plus the resistance of self-biased transistor 317, so $V_{10}$ is larger than the potential $(V_{43}-V_{12})$ between terminals 12 and 43 by a factor substantially equal to $[1+(R_{315a}/R_{315b})]$. $(V_{43}-V_{12})$ can be adjusted to have zero temperature coefficient in much the same way as described in connection with regulator 200. Then, $R_{315a}/R_{315b}$ can be adjusted to obtain the required value of $V_{10}$. $R_{315a}$ and $R_{315b}$ may be replaced by a non-integrated potentiometric network. In another modification of regulator 300, resistor 315*c* is dispensed with and $R_{315a}$ and $R_{315b}$ are caused to have a parallel resistance greater than $R_{116}$ and equal essentially to $R_{315c}$ of replaced resistor 315*c*. $R_{315a}/R_{315b}$ is adjusted to adjust the nominal value of $V_{10}$, and the gain of current amplifier 21 or the ratio to $R_{116}$ of the parallel resistance of resistors 315*a* and 315*b* is adjusted to trim the zero temperature coefficient of $V_{10}$.

There are possible variations of regulator 300 in which self-biased transistor 317 is replaced by other semiconductor diode means —e.g., serially connected self-biased diodes. Also, resistor 315*c* may be between terminals 43 and 14 and the diode means connected between terminals 11 and 13, although care must be taken to provide sufficient operating voltage for the current source (e.g., 29, 35) supplying the emitter electrodes of transistors 18 and 19.

What is claimed is:

1. A voltage reference circuit comprising:

first and second terminals between which reference voltage is to appear in response to applied current;

a resistive element;

at least one semiconductor diode means operated at at absolute temperature T and connected in a serial combination with said resistive element;

means applying a substantially fixed portion of any potential appearing between said first and said second terminals across said serial combination to forward-bias each said semiconductor diode means and thereby cause it to exhibit an offset potential with a negative-temperature coefficient;

means responsive to the potential drop across said resistive element due to said applied current being in excess of a threshold potential, which threshold potential is linearly proportionally related to said absolute temperature T, to provide an error signal directly related to said excess; and means responsive to said error signal for shunt regulating the portion of said applied current flowing through said serial combination.

2. A voltage reference circuit as claimed in claim 1 wherein said means to provide an error signal comprises:

first and second transistors of the same conductivity type, being operated at an absolute temperature substantially equal to T, having respective base electrodes between which said resistance is connected, having respective emitter electrodes joined at an interconnection, and having respective collector electrodes;

a first current amplifier having input and common and output terminals, the collector electrode of said first transistor being connected to the input terminal of said first current amplifier, and the collector electrode of said second transistor and the output terminal of said first current amplifier being connected to a circuit node at which said error signal obtains; and a source of current, connected between the common terminal of said first current amplifier and the interconnection at which the emitter electrodes of said first and said second transistors join.

3. A voltage reference circuit as claimed in claim 2 wherein said means for shunt regulating comprises:

a second current amplifier having an input terminal connected to said circuit node at which said error signal obtains, and having output and common nodes connected to separate ones of said first and said second terminals to complete a degenerative feedback loop.

4. A voltage reference circuit as set forth in claim 1 wherein each said semiconductor diode means is a self-biased transistor.

5. A voltage reference circuit comprising:

a conduction path between first and second nodes through at least one semiconductor junction, each arranged to operate at a temperature substantially equal to T;

means applying a current to said conduction path to forward bias each said semiconductor junction therein and thereby develop an offset potential across each said semiconductor junction;

first and second transistors of the same conductivity type, having respective base-emitter junctions in 1:*m* ratio, having respective base and emitter and collector electrodes, being arranged to operate at respective temperatures each substantially equal to T, and being connected together in emitter-coupled differential amplifier configuration;

a current amplifier having input and output terminals between which a current gain of $-g$ is exhibited, and having a common terminal, *m* and *g* being positive numbers the product of which differs from unity;

means connecting said current amplifier as a balanced to single-ended signal converter for the direct collector currents of said first and said second transistors including a direct current conductive connection of the collector electrode of said first transistor to the input terminal of said current amplifier and direct current conductive connections of the collector electrode of said second transistor and of the output terminal of said current amplifier to a third node;

a direct coupled degenerative feedback connection from said third node to the base electrodes of said first and said second transistors for reducing the imbalance between the current flows into and out of said third node, thereby to cause a difference potential between the base electrodes of said first and second transistor;

means for deriving a potential proportional to said differential potential; and means for summing each said offset potential, said difference potential and said potential proportional to said difference potential together to provide an output reference voltage.

6. A shunt potential regulator circuit for providing a standard potential substantially constant despite changes in the temperature of elements in said shunt potential regulator circuit, which shunt potential regulator circuit comprises:

first and second terminals for application of operating current, also between which terminals said standard potential is provided;

resistive potential divider means having an input circuit and an output circuit;

semiconductor diode means in a first series connection with the input circuit of said resistive potential divider means between said first and said second terminals;

first and second transistors of the same conductivity type, having respective base electrodes between which the output circuit of said resistive potential divider means is connected, having respective emitter electrodes directly connected together at an interconnection, having respective base-emitter junctions with respective areas in 1-to-*m* ratio, having respective collector electordes, and being operated at essentially the same temperature as said semiconductor diode means, a source of combined emitter bias currents for said first and said second transistors, said source being connected between said first terminal and said interconnection of their emitter electrodes;

a first amplifier having input and output circuits to which the collector electrodes of said second and said first transistors are respectively connected, said first amplifier exhibiting a predetermined constant current gain of $-g$ between its input and output circuits, *m* and *g* being positive numbers the product of which differs from unity;

a second amplifier having an input circuit to which the output circuit of said first amplifier is direct coupled and having an output circuit connected between said first and said second terminals to complete a degenerative feedback connection of the foregoing elements for regulating the potential between said first and said second terminals.

7. In combination:

a current supply having first and second terminals, one of which is negative and the other positive;

first and second resistances in constant proportion with each other despite change in their operating temperatures;

diode means having and anode an cathode for responding to current flow between its anode and cathode and to an absolute temperature T with a negative-temperature-coefficient potential between its cathode and anode, which negative-temperature coefficient potential is proportional to the offset potential of a semiconductor junction exposed to such current and temperature conditions;

a serial connection of said first and said second resistances and said diode means between the positive and negative terminals of said current supply, the anode and cathode of said diode means disposed respectively closer to the positive terminal of said current supply and closer to the negative terminal of said current supply;

first and second transistors, being of the same basic semiconductor material and of the same conductivity type, being operated at respective absolute temperatures, each substantially equal to T, having respective base and emitter and collector electrodes, having their respective base electrodes connected to opposite ends of said first resistance, and having respective base-emitter junctions with respective areas in *m*:1 ratio, *m* being a positive number;

a current amplifier having an input terminal to which the collector electrode of said first transistor is galvanically coupled, having output and common terminals, and exhibiting a current gain of $-g$ between its input and output terminals, *g* being a positive number which when multiplied by *m* yields a product different from unity;

means for applying current to an interconnection of the emitter electrodes of said first and second transistors in a poling to forward-bias the base-emitter junctions of said first and said second transistors;

means for supplying a response current linearly related to the sum of currents galvanically coupled thereto from the collector electrode of said second transistor and from the output terminal of said current amplifier, said response current applied across said serial connection of said first and said second resistances and said diode means to regulate the potential across said first resistance to reduce said response current by degenerative feedback.

* * * * *

UNITED STATES PATENT OFFICE
CERTIFICATE OF CORRECTION

PATENT NO. : 4,088,941

DATED : May 9, 1978

INVENTOR(S) : Carl Franklin Wheatley, Jr.

It is certified that error appears in the above-identified patent and that said Letters Patent are hereby corrected as shown below:

Col. 1, Line 15, "the" should be --The--

Col. 2, Line 36, "lend" should be --tend--

Col. 3, Line 29, "transistor" should be --transistors--

Line 50, "kT/g" should be --kT/q--

Line 67, "kT/g" should be --kT/q--

Col. 4, Line 19, "after" should be --alter--

Col. 5, Line 33, "$I_E/A_2$" should be --$I_{E2}/A_2$--

Col. 5, Equation 2, "kT/g" should be --kT/q--

Col. 10, Line 31, "and anode an" should be --an anode and--

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*